United States Patent [19]

Sevier

[11] 4,434,838

[45] Mar. 6, 1984

[54] APPARATUS AND PROCESS FOR COOLING AND SOLIDIFYING CONTINUOUS OR SEMI-CONTINUOUSLY CAST MATERIAL

[75] Inventor: Peter E. Sevier, Woodbridge, Conn.

[73] Assignee: Olin Corporation, New Haven, Conn.

[21] Appl. No.: 272,132

[22] Filed: Jun. 10, 1981

[51] Int. Cl.[3] ..... B22D 11/124

[52] U.S. Cl. ..... 164/485; 164/467; 164/444; 164/348

[58] Field of Search ..... 164/443, 444, 455, 485, 164/486, 501, 503, 348, 487, 462, 467, 475, 66.1, 415, 423

[56] References Cited

U.S. PATENT DOCUMENTS

| | | | |
|---|---|---|---|
| 2,686,864 | 8/1954 | Wroughton et al. | 219/17.5 |
| 2,828,231 | 3/1958 | Henry | 134/1 |
| 3,066,084 | 11/1962 | Osterman et al. | 204/141.5 |
| 3,194,640 | 7/1965 | Nesh | 23/293 R |
| 3,324,932 | 6/1967 | Ayers | 164/485 |
| 3,467,166 | 9/1969 | Getselev et al. | 164/467 |
| 3,511,488 | 5/1970 | Stubblefield | 266/170 |
| 3,543,831 | 12/1970 | Schile | 164/486 |
| 3,685,568 | 8/1972 | Pond | 164/462 |
| 3,735,799 | 5/1973 | Karlson | 164/467 |
| 4,153,099 | 5/1979 | Pflieger | 164/462 |
| 4,158,379 | 6/1979 | Yarwood et al. | 164/467 |
| 4,161,206 | 7/1979 | Yarwood et al. | 164/467 |
| 4,167,424 | 9/1979 | Jubenville et al. | 134/1 |
| 4,168,295 | 9/1979 | Sawyer | 422/111 |
| 4,351,384 | 9/1982 | Goodrich | 164/467 |
| 4,373,571 | 2/1983 | Yarwood et al. | 164/503 X |

OTHER PUBLICATIONS

National Technical Information Service, Report PB 248 963, "Scale-Up of Program On Continuous Silicon Solar Cells", by A. D. Morrison, Sep. 1975.

"The Role of Surface Tension in Pullin Single Crystals of Controlled Dimension", Metallurgy of Elemental And Compound Semiconductors, pp. 201-226, Published by Interscience Publishers, Inc., New York, 1961 (Article by Gaule et al.).

"Heat Transmission Through Fluidized Beds Of Fine Particles", by Leva et al., Chemical Engineering Progress, vol. 45, No. 9, pp. 563-572, Published in Sep. 1949.

"Heat Transfer Characteristics of Fluidized Beds", by Mickley et al., Industrial And Engineering Chemistry, vol. 41, No. 6, pp. 1135-1147, Published in Jun. 1949.

"Fluidised Beds-Advances and Advantages", by Keirle, Metallurgia, pp. 416-418, Published in Jun. 1979.

"Heat Transfer Between a Vertical Tube and a Fluidized Air-Solid Mixture", by Dow et al., Chemical Engineering Progress, vol. 47, No. 12, pp. 637-648, Published in Dec. 1951.

"The Continuous Heat Treatment Of Wire Using Fluidized Beds", by Virr, provided by Fennell Corporation, Harvey, Illinois, Jul. 29, 1980.

*Primary Examiner*—Gus T. Hampilos

*Attorney, Agent, or Firm*—Paul Weinstein; Howard M. Cohn; Barry L. Kelmachter

[57] ABSTRACT

An apparatus and process for casting a material comprising a coolant application device comprising a fluidized bed coolant system. The casting is carried out utilizing a casting mold which defines a casting zone. A soundwave generating system is provided for enhancing the flow of the fluidized bed into the vicinity of the casting zone.

26 Claims, 8 Drawing Figures

APPARATUS AND PROCESS FOR COOLING AND SOLIDIFYING CONTINUOUS OR SEMI-CONTINUOUSLY CAST MATERIAL

While the invention is subject to a wide range of applications it is especially suited for use in continuous or semi-continuous casting particularly electromagnetic casting of thin strip material and will be particularly described in that connection.

The process and apparatus are preferably used to more rapidly extract heat from molten material being cast so that the casting speed can be increased. The present invention is particularly adapted for the casting of very thin strip cross sections from materials comprising reactive metals or alloys, semi-metals and semi-conductors, etc., which require the use of an inert cooling medium such as an inert gas.

In U.S. application Ser. No. 139,617, filed Apr. 11, 1980, now U.S. Pat. No. 4,353,408, by Pryor apparatuses and processes are described for the casting of such materials in a thin strip form. The speed at which the material can be cast by the Pryor apparatus is limited principally by the rate at which heat can be extracted from the molten material during casting. The necessity to utilize an inert cooling medium imposes severe constraints on the heat extraction ability of the coolant application system.

One approach to providing a suitable coolant application system in the electromagnetic casting of materials as described above is set forth in U.S. patent application Ser. No. 213,126, filed Dec. 4, 1980, now U.S. Pat. No. 4,358,416, by Yarwood et al. (1). The coolant application system provides for the application of high pressure inert gas such as argon or helium to the solidifying strip and its transport around the periphery of a molten material sump contained by an upper inductor. Such a cooling system while capable of producing strip in the manner described is still limited in the casting rates which are achievable and much higher casting rates are desired.

U.S. Pat. No. 3,735,799 to Karlson sets forth an electromagnetic casting apparatus wherein coolant is applied to the solidifying and solidified surface of the ingot.

In accordance with the present invention a fluidized bed coolant application system is employed which is capable of providing higher heat transfer rates than the gas cooling system of the prior art. The higher heat transfer rates enables the casting rate to be markedly increased.

While the fluidized bed coolant application system of this invention has particular application with respect to electromagnetic casting wherein the material is molded by levitation and, therefore, without contact of a chill mold it could be applied to other forms of continuous and semi-continuous casting and for any desired material including conventional nonreactive metals and alloys.

A variety of processes have been developed for forming materials such as silicon into a thin strip shape. Examples of such approaches can be found in National Technical Information Service Report PB-248963 "Scale-Up of Program on Continuous Silicon Solar Cells" by A. D. Morrison, published in September 1975, and a paper entitled "The Role of Surface Tension in Pulling Single Crystals of Controlled Dimensions" by G. K. Gaule et al. from Metallurgy of Elemental and Compound Semiconductors, published by Interscience Publishers, Inc., New York in 1961, pages 201–226.

A considerable body of art has developed with respect to the use of electromagnetic containment for the purposes of casting metals as in U.S. Pat. No. 2,686,864 to Wroughton et al. A typical commercial electromagnetic casting apparatus comprises a three-part mold consisting of a water cooled inductor, a non-magnetic screen, and a manifold for applying cooling water to the resultant casting. Such an apparatus is exemplified in U.S. Pat. No. 3,467,166 to Getselev et al. Containment of the molten metal is achieved without direct contact between the molten metal and any component of the mold. Solidification of the molten metal is attained by the direct application of water from a cooling manifold to the solidifying shell of the casting. An elaborate discussion of the prior art relating to electromagnetic casting is found in U.S. Pat. No. 4,161,206 to Yarwood et al. (2). That prior art statement is intended to be incorporated by reference herein. The Yarwood et al. (2) patent deals with a control system for controlling the electromagnetic process which is believed to have particular use in the apparatus of the present invention.

It has been found desirable with a casting apparatus for thin strip materials as described in the Pryor application to employ multiple inductors comprising a sump supporting inductor and a strip shaping inductor. Further, as set forth in U.S. application Ser. No. 191,630, filed Sept. 29, 1980, by Pryor et al. It is preferred to employ a relatively higher frequency for the shaping inductor as compared to the sump supporting inductor.

A number of systems have been devised in the prior art for replenishing the molten material sump during a casting operation and controlling the replenishment based upon an electrical parameter of the casting system such as inductance. Such an approach is clearly illustrated in U.S. application Ser. No. 110,893, filed Jan. 10, 1980, now abandoned and refiled as U.S. application Ser. No. 350,846, filed Feb. 22, 1982, by Ungarean et al. The replenishment of the sump may be through the addition of molten material or solid material as desired. The aforenoted Pryor application described in particular the addition of a solid material controlled in the manner of Ungarean et al.

The use of fluidized beds in metallurgical applications for heating and cooling is set forth in a number of articles comprising: "Heat Transmission Through Fluidized Beds Of Fine Particles" by Leva et al., Chemical Engineering Progress, Vol. 45, No. 9, Pages 563–572, published in September 1949; "Heat Transfer Characteristics of Fluidized Beds" by Mickley et al., Industrial And Engineering Chemistry, Vol. 41, No. 6, Pages 1135–1147, published in June 1949; "Fluidised beds-advances and advantages" by Keirle, Metallurgia, Pages 416–418, published in June 1979; "Heat Transfer Between a Vertical Tube and a Fluidized Air-Solid Mixture" by Dow et al., Chemical Engineering Progress, Vol. 47, No. 12, Pages 637–648, published in December 1951; "The Continuous Heat Treatment Of Wire Using Fluidized Beds" by Virr, provided by Fennel Corporation, Harvey, Ill., July 29, 1980.

While fluidized beds as described in the aforenoted articles have found some metallurgical applications it is not apparent that the prior art has recognized the unique applicability of fluidized beds as a coolant application system in the continuous or semi-continuous casting of materials such as metals, semi-metals, semiconductors, etc., particularly when such materials are reactive in nature.

In electromagnetic casting it is known that the interface position between the liquid and solid should be maintained at the electrical centerline of the inductor. A number of approaches have been devised for controlling the position of the liquid solid interface. For example, U.S. Pat. No. 4,158,379 to Yarwood et al. (3) shows the movement of a coolant application manifold in order to reposition the liquid solid interface. Similarly, U.S. application Ser. No. 957,420, filed Nov. 2, 1978, now U.S. Pat. No. 4,388,963, by Yarwood et al. (4) discloses the use of a pulsed application of coolant in order to control heat extraction rate and thereby the liquid solid interface position.

A number of atypical coolant application systems for producing fibers, filaments or wire for molten metal are described in U.S. Pat. Nos. 3,543,831 to Schlle, 3,685,568 to Pond and 4,153,099 to Pflieger.

Ultrasonic energy has been employed in a wide variety of applications in the chemical and metallurgical industry as exemplified in U.S. Pat. Nos. 2,828,231 to Henry, 3,066,084 to Osterman et al., 3,194,640 to Nesh, 3,511,488 to Stubblefield, 4,167,424 to Jubenville et al. and 4,168,295 to Sawyer.

In accordance with the present invention an apparatus and process is provided for the casting of desired shapes, preferably thin strip shapes, at increased casting rates. Preferably, the apparatus and process employ an electromagnetic thin strip casting arrangement wherein the material being cast is levitated in both the sump and the strip forming portion of the casting unit. This provides improved purity in the resultant casting since interactions with refractories or other mold materials are substantially eliminated.

It has been found that a major constraint in providing increased casting rates comprises the heat transfer capability of the coolant application system. This is particularly the case when casting materials which are either highly reactive or have relatively low thermal conductivities in the solid state. Previously, it had been proposed to cast such materials by employing a gas cooling system. Gas cooling, however, by virtue of its heat transfer capabilities is not suitable for casting at relatively high casting rates.

In accordance with the present invention the coolant application system employs a fluidized bed of inert particles such as sand. Such a fluidized bed is capable of markedly higher heat transfer rates than a gas cooling system. Further, such a fluidized bed since it utilizes a gas to provide fluidization is capable of utilizing an inert gas such as helium, argon, etc., which will not react with the material being cast. Therefore, the use of a fluidized bed coolant application system in accordance with this invention provides all the advantages of a gas coolant system with the further marked advantage of improved heat transfer rates.

In accordance with the present invention the cooling effectiveness of the fluidized bed in the region of the casting zone is augmented. This is accomplished by providing a flow enhancing means which can enhance the flow of the fluidized bed into the casting zone. In accordance with a preferred embodiment this is accomplished through the use of sound generators which generate sound waves moving in a direction so as to impact the strip being cast near or at the casting zone. The frequency of the sound waves may be selected as desired to provide the enhanced flow of the fluidized bed. Alternative means for providing the enhanced flow could include fans or gas jets providing an enhanced gas flow direction directed at the casting zone.

Accordingly, it is an object of this invention to provide an improved apparatus and process for continuous or semicontinuous casting.

It is a further object of this invention to provide an apparatus and process as above having an improved casting rate.

It is a still further object of this invention to provide an apparatus and process as above which is adapted for the electromagnetic casting of very thin strip shapes of highly reactive materials.

It is yet a further object of this invention to provide an apparatus and process as above which includes a system for providing flow enhancement of the fluidized bed at the casting zone.

These and other objects will become more apparent from the following description and drawings.

Figure 5:
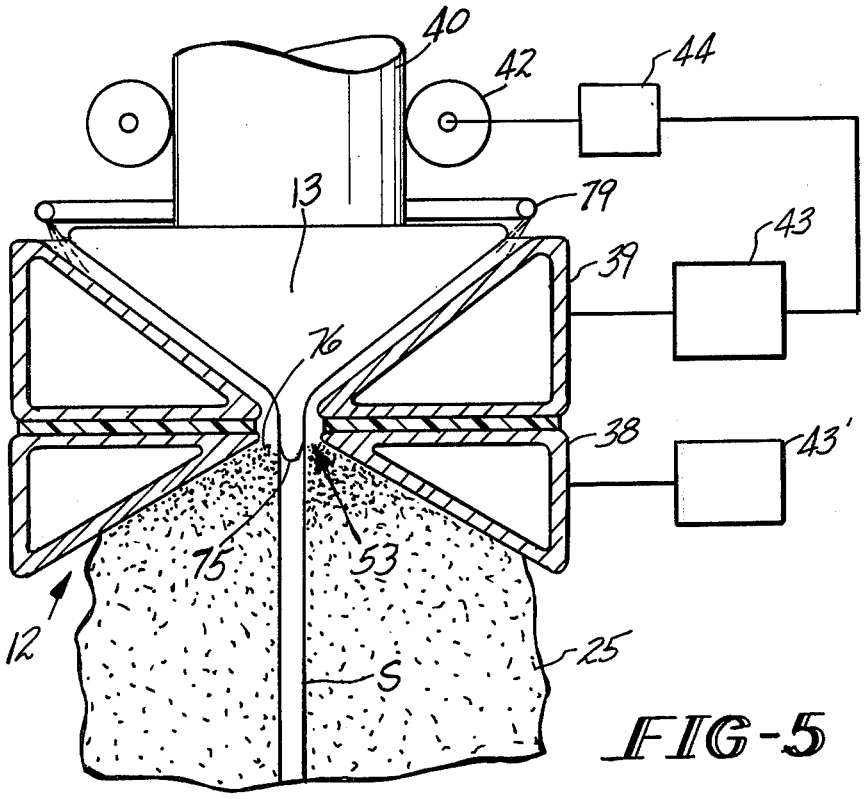
FIG. 5 is a further enlargement of the containment and cooling portions of the apparatus of FIG. 4.
Figure 6:
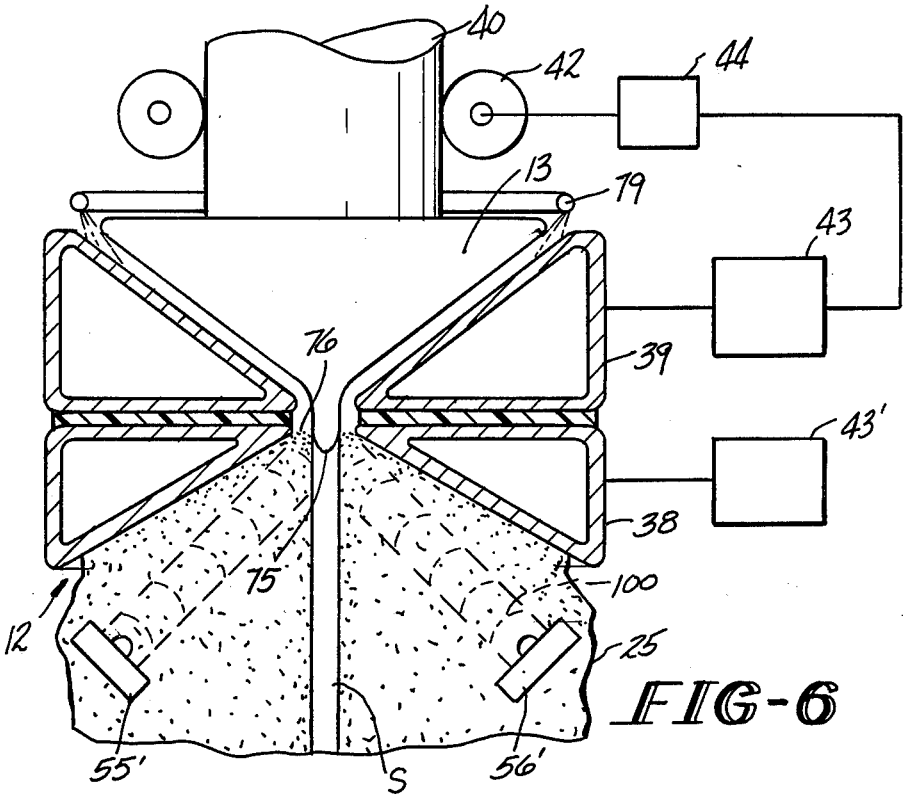
Figure 7:
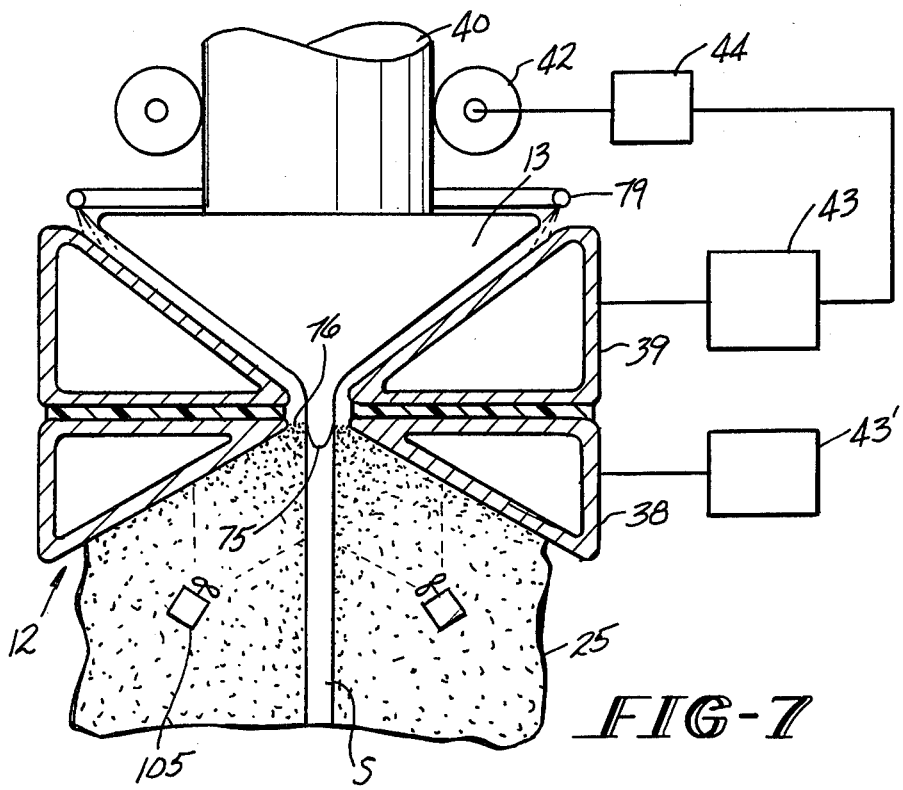
Figure 8:
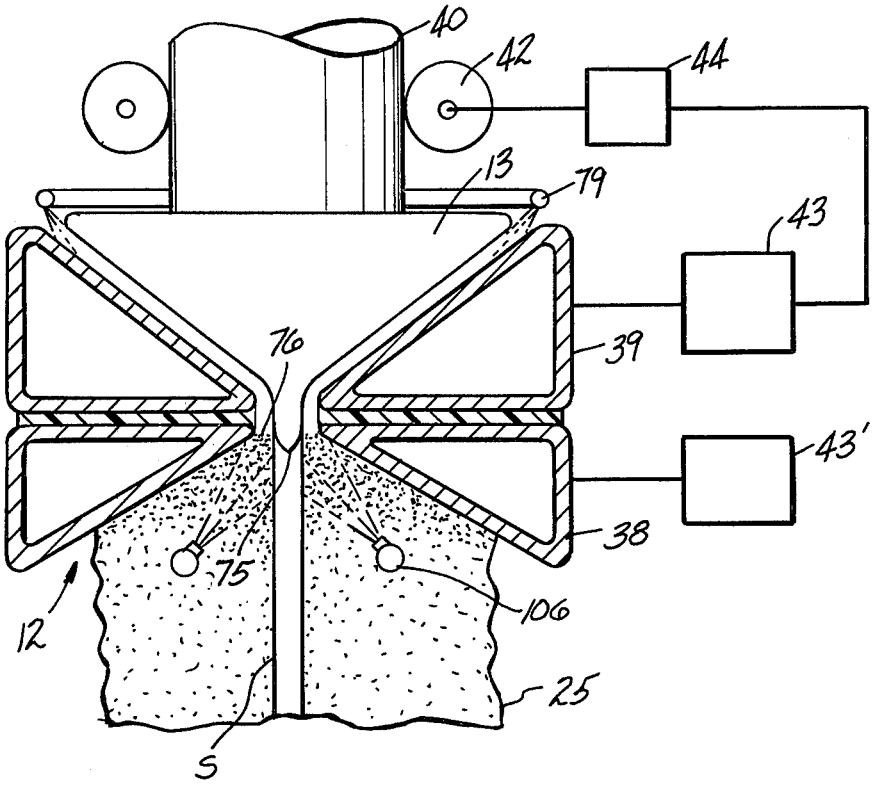

FIG. 6 comprises a schematic representation of an apparatus as in FIG. 5 further including ultrasonic flow enhancement;

FIG. 7 comprises a schematic representation of an apparatus as in FIG. 5 further including flow enhancement by means of fans; and FIG. 8 is a schematic representation of an apparatus as in FIG. 5 further including flow enhancement by means of gas jets.

In accordance with the present invention an apparatus 10 and process are provided for casting, preferably in thin strip form, materials such as reactive metals, particularly those having a high melting point such as titanium, zirconium, vanadium, tantalum, molybdenum and tungsten as well as other metals, alloys, metalloids and semi-conductive materials such as silicon. These materials are preferably cast under conditions employing inert atmospheres or vacuums to avoid the formation of excessive oxides. The prior art approaches as described heretofore require sophisticated control of atmosphere in order to yield a clean uncontaminated thin strip product irrespective of the casting method. The electromagnetic casting method is strongly preferred because of the absence of contact with a crucible or mold which eliminates the attendant contamination problems. The prior art cooling approach employing gas cooling restricts the output of the casting machine making the process preferred for use only with extremely expensive materials such as high purity silicon. Much higher casting rates are desired not only for such high purity materials such as silicon but also for refractory high melting point metals such as the reactive metals described above. In accordance with the present invention an apparatus 10 has been devised for achieving significantly higher cooling rates in a continuous or semi-continuous casting apparatus than can be achieved by the approaches of the prior art. This is accomplished in accordance with the present invention through the use of a fluidized bed cooling apparatus 10 and process.

Figure 1:
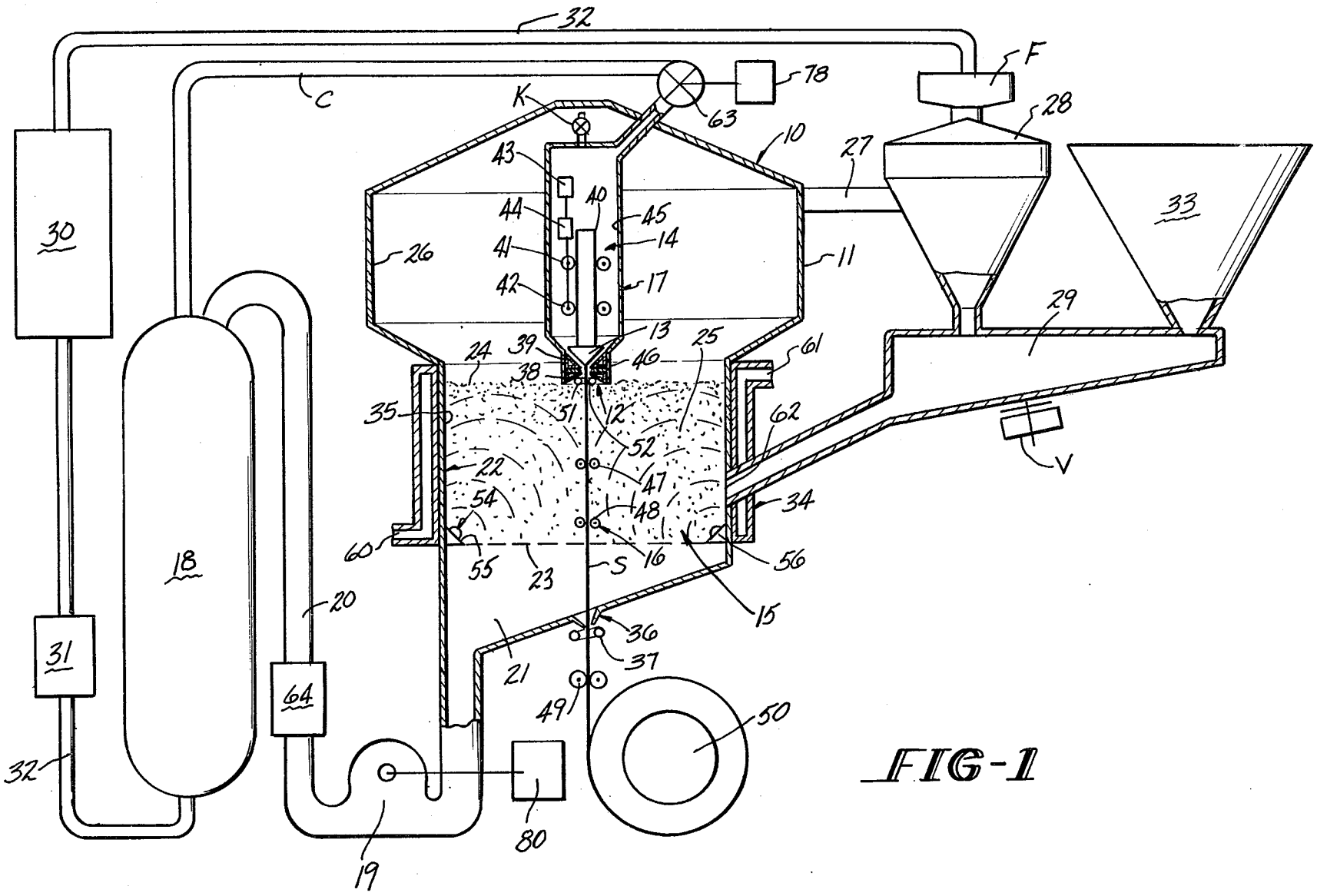
FIG. 1 is a schematic representation in partial cross section of an apparatus in accordance with the present invention.
Figure 2:
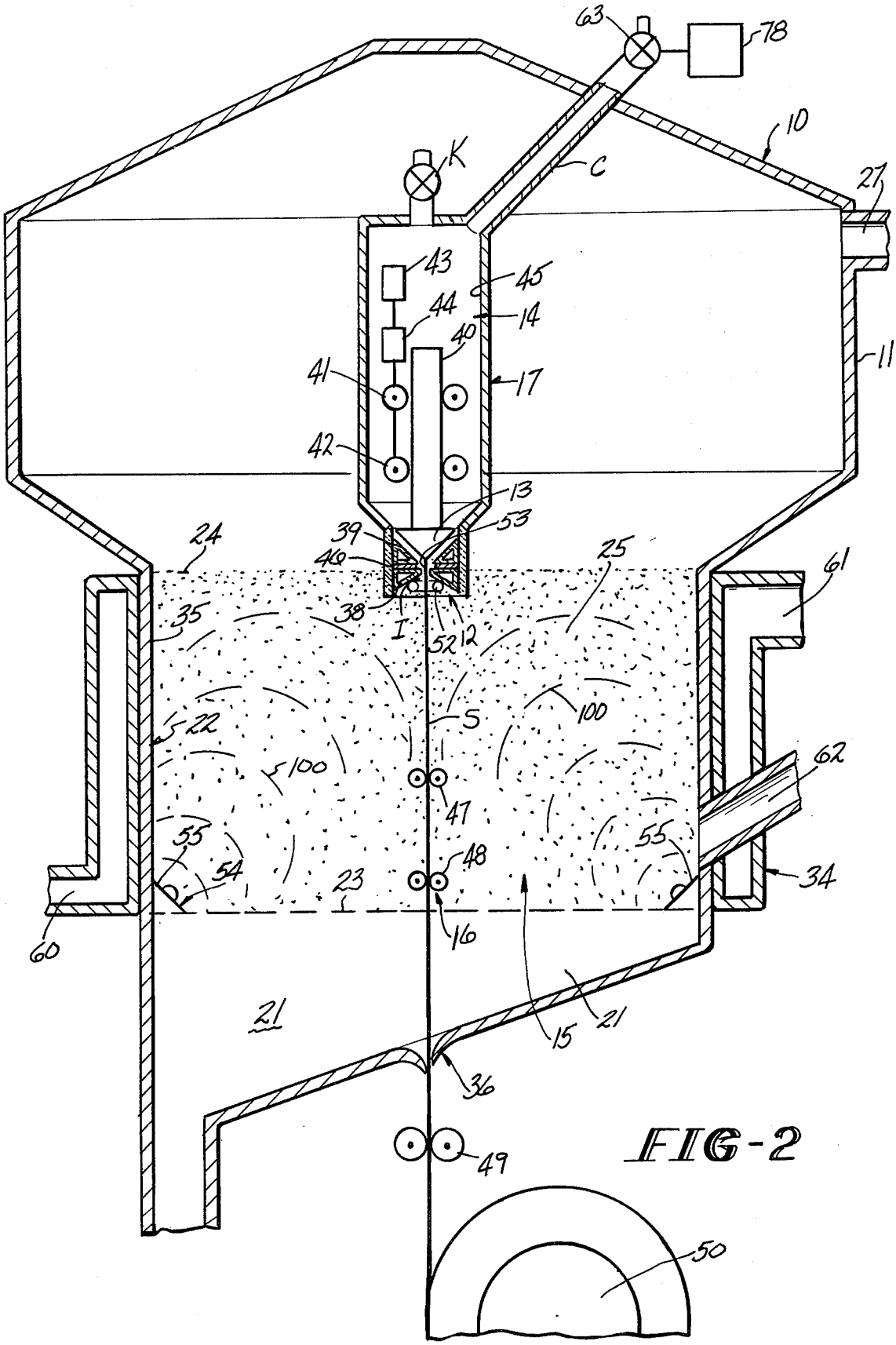
FIG. 2 is an enlarged schematic representation of the casting and cooling stations in accordance with one embodiment of this invention.
Figure 3:
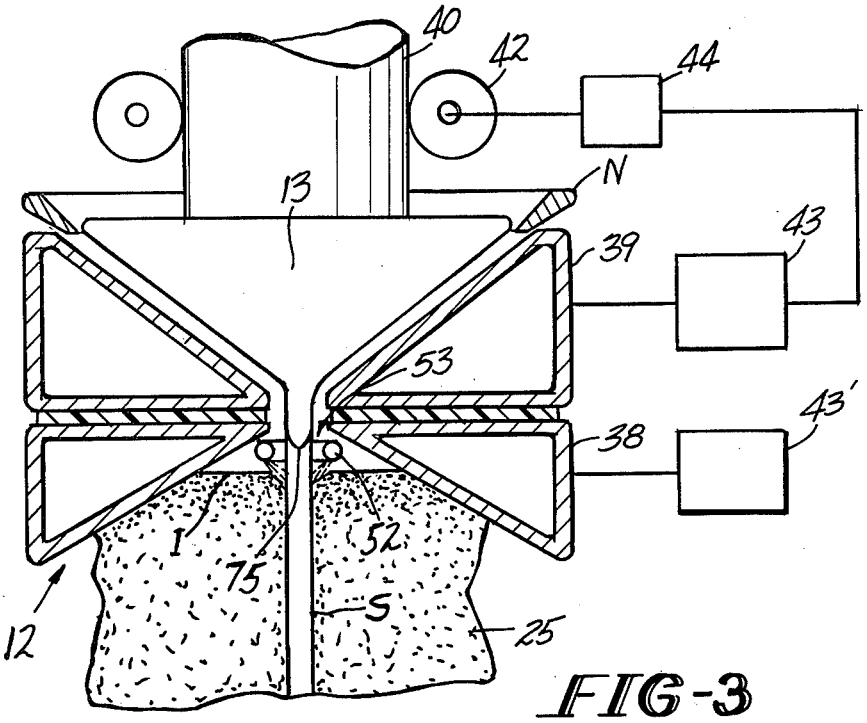
FIG. 3 is a still further enlargement of the containment and cooling sections of the apparatus of FIG. 2.

Referring now to FIGS. 1 through 3 there is shown by way of example an apparatus 10 in accordance with one embodiment of the present invention. The apparatus 10 includes a casting chamber 11. The casting chamber 11 surrounds an electromagnetic casting mold 12 which also supports in a levitated fashion a sump 13 of molten material. The casting system further includes a means 14 for replenishing the material in the sump 13 as it is depleted in the casting operation, a cooling system 15 comprising a fluidized bed in accordance with the present invention, means 16 for transporting the resultant strip product S out of the casting chamber 11 and an isolation chamber 17 surrounding the casting mold 12 and replenishment system 14.

The casting chamber 11 and the isolation chamber 17 are provided with an inert gas atmosphere. The inert gas may be any desired inert gas including helium, argon, etc. The inert gas in the casting chamber 11 is supplied by the fluidized bed cooling system 15 and comprises the gas utilized in fluidizing the particle bed. The inert gas supplied to the isolation chamber 17 is provided from a source 18 of inert gas which supplies both the isolation chamber 17 and the fluidized bed coolant system 15. The inert gas source 18 can be any desired source such as a tank of compressed gas.

A blower 19 in the conduit 20 between the inert gas source 18 and the fluidized bed gas plenum 21 is used to provide a desired flow of inert gas necessary to fluidize a bed of preferably inert particles such as sand. The sand particles are arranged in a lower portion of the casting chamber 11 which comprises the fluidized bed chamber 22. The gas flow which is created by the blower 19 through fluidized bed plenum 21 passes through a screen 23 which forms the bottom of the fluidized bed chamber 22 and prevents sand particles from falling into the plenum 21. When the bed is properly fluidized, the top surface 24 of the bed 25 will be at least as high as is desired for the fluidized bed to contact the resultant product S at an appropriate coolant application position.

When the proper conditions have been maintained to provide the desired fluidized bed 25, most of the particles will remain in the bed being levitated therein by the flow of inert gas. The upper portion 26 of the casting chamber 11 flares out in order to provide a disengagement zone to provide separation of the bed particles and the gas. The gas then flows out of the upper portion 26 of the casting chamber 11 via conduit 27 which is in communication with a cyclone separator 28 which separates any remaining entrained particles from the gas flow. Any particles so separated are returned to a particle supply conduit 29. The gas from the separator 28 passes through a filter F to further remove entrained particles and then through a heat exchanger 30 to reduce its temperature back to its desired coolant temperature. A pump 31 then pumps the gas via conduit 32 back into the gas supply system 18.

Additional bed particles for addition to the fluidized bed 25 are maintained in a supply hopper 33 connected to the supply conduit 29. The particles from the hopper 33 and the cyclone separator 28 fall into the supply conduit 29 which in turn is vibrator V actuated so that a desired amount of particles can be metered into the fluidized bed chamber 22 by vibrating the conduit 29 for a desired period of time.

In order to cool the fluidized bed 25 in operation a cooling jacket or plenum 34 for water or other desired coolant is provided in heat exchange contact with the surrounding lateral wall 35 of the fluidized bed chamber 22 extending from the screen 23 level to a height at which the fluidized bed no longer exists. The fluidized bed 25 contacts this cooled wall 35 and is itself cooled so as to provide enhanced cooling of the resultant cast strip S.

Details of the cyclone separator 28 particle supply 33, inert gas supply 18 and inert gas heat exchanger 30 are not presented as they can comprise any well-known design as are known in the art particularly the art noted in the background of this application. While a coolant 32 and heat exchanger 30 are provided for returning the gas emitted after filtering to the original gas supply 18 if desired the gas could merely be exhausted in a conventional fashion and only virgin inert gas utilized in the process.

In the embodiment of FIG. 1 the fluidized bed plenum 21 is sealed against the strip S by means of rubber wipers 36 as will be described hereafter. Alternatively, a seal can be provided by a flow of gas from a suitable plenum 37 surrounding the strip and connects to a gas supply (not shown).

The electromagnetic containment system 12 may be any desired system for containing and forming the resultant strip product. A particularly useful approach is described in U.S. patent application Ser. No. 213,127, filed Dec. 4, 1980, now abandoned and refiled as U.S. patent application Ser. No. 257,442, filed Apr. 24, 1981, now U.S. Pat. No. 4,373,571, to Yarwood et al. (5). In the approach of Yarwood et al. (5) the inductor 38 which shapes the molten material into the desired thin strip shape defines a containment zone of 5 millimeters or less. The shaping inductor 38 is preferably in communication with a sump 13 levitating inductor 39 of the type described in the Pryor application. In the Pryor approach a sump 13 of molten material is levitated by inductor 39 above the shaping inductor 38 so that all contamination with crucibles or the like is avoided.

In order to replenish the sump 13 as the material is being cast a system as described by Ungaren or Pryor can be utilized. In the system shown in FIGS. 1–3 a solid bar 40 of the material being cast is advanced by pinch rollers 41 and 42 at a rate controlled in a manner so as to replenish the sump. A control system 13 senses an electrical parameter which is a function of hydrostatic pressure of the molten material and then energizes motor 44 to feed the solid material 40 into the melt at a rate so as to maintain a constant hydrostatic pressure and, therefore, a constant level in the sump.

In the embodiment shown in FIGS. 1–3 the casting mold 12 and the replenishment system 14 are preferably arranged in an inner chamber 17 which is separately supplied with an inert gas. The purpose of utilizing such an inner chamber 17 is to reduce the likelihood of contamination of the material being cast by the particles utilized in the fluidized bed. While it is preferred in accordance with this invention to utilize such an internal chamber 17 it is not believed to be essential since it is thought that only a small percentage of particles would be entrained in the gas in the upper portion 26 of the casting chamber 11 and that those particles would not because of their small size and the surface tension of the molten material 13 become entrained in the resultant casting S. However, to reduce the possibility of contamination the inner chamber 17 is provided with a slight positive pressure which prevents the entrance of the bed particles into the chamber 17. The walls 45 of the inner chamber 17 are constructed of any suitable material. At least that portion 46 of the walls 45 which comes in contact with the inductors 38 and 39 are formed of an insulating material such as alumina. The remaining portions of the inner chamber walls 45 which are not affected by the field of the inductors can be formed of any desired material such as a metal though preferably a non-magnetic metal is employed.

The resultant thin strip casting S is withdrawn downwardly from the electromagnetic casting mold by means of withdrawal rolls 47, 48 and 49 and upon exiting the fluidized bed plenum it can be coiled upon large diameter drum 50. While it is preferred to coil the thin strip material S if desired the material may be cast in long uncoiled strip shapes by means of a conventional bottom block and moving ram approach. Further details of the electromagnetic casting process itself can be found by reference to the application of Pryor.

At start up a suitable starter strip (not shown) would be provided within the shaping inductor 38. This starter strip would be coiled at its opposite end on the drum 50. It would then be withdrawn as the casting is formed and when the actual material being cast reaches the drum 50 it in turn would be coiled on the drum.

It is also possible in accordance with this invention to control the flow of gas for fluidizing the cooling bed 25 in a manner so as to determine the top surface 24 position of the fluidized bed coolant 25 and thereby the position 51 at which the bed 25 first contacts the material S to be cooled. Alternatively, the flow of gas into the internal chamber 17 can be controlled to provide control of the line of first contact 51 between the fluidized bed 25 and the casting S. In the embodiment shown in FIG. 1 primary cooling is provided by a gas flow manifold 52 as described in the Yarwood et al. (1) application. However, as will be shown hereafter the primary cooling can comprise the fluidized bed 25 itself.

In fluidizing the bed 25 the gas flow is directed generally vertically upward. The width of the bed 25 as compared to the width of the electromagnetic mold system 12 is preferably large thereby the obstruction posed by the electromagnetic mold system 12 will comprise but a minor obstruction to the gas flow and it should be possible to have the fluidized bed 25 extend up into the casting zone 53 as in FIG. 5.

In order to further overcome the effects of the casting mold from a gas flow obstruction point of view it is proposed to provide a system 54 for assisting the flow of the fluidized bed in the region of the containment zone 53. This can be accomplished in any number of ways and as shown in FIGS. 1–3 it could be provided by sound transducers 55 and 56 located at the walls 35 of the fluidized bed chamber 22. Further details of this approach will be described hereafter.

Referring now to FIGS. 2 and 3 one embodiment of the invention will be illustrated in greater detail. In this embodiment the fluidized bed cooling system 15 is utilized as a secondary cooling system. The primary cooling system comprises a gas cooling system 52 wherein a cooling gas flows upwardly past the casting zone 53 and then between the inductor 39 and the molten material sump 13 and outwardly therefrom.

The inductors 38 and 39 are preferably independently powered by conventional power supplies and control systems 43 and 43' preferably of the type described in the Yarwood et al (2) patent. While this control system and power supply arrangement is preferred in accordance with the present invention any desired control system and power supply could be employed. The upper inductor 39 preferably levitates a sump 13 of molten material. The lower inductor 38 is preferably shaped to provide a less than about 5 millimeter shaping zone much in the manner of Yarwood et al. (5).

A shield N as shown in FIG. 3 may if desired be employed to prevent excessive rounding out of the upper portion of the sump. However, it may be possible as in accordance with the teachings of the Pryor application that the shield N can be eliminated by suitably shaping the inductor 39.

The control system 43 for the upper inductor 39 also is utilized to control the advance of the solid material member or rod 40 into the molten material sump 13 in a manner so as to maintain the hydrostatic pressure exerted by the molten material substantially constant. This can be accomplished by utilizing an electrical parameter of the control system which varies in a manner corresponding about to the hydrostatic pressure. The current in the inductor 39 or inductance of the inductor 39 are two such parameters that can be utilized. The control system 43 is connected to a motor 44 which in turn is connected to the feed rolls 41 and 42 for advancing the material into the melt. In order to make a long casting run it is proposed to utilize a large replenishment member 40 and, therefore, as shown in FIG. 2 more than one set of feed rolls 41 and 42 are preferably utilized in order to control the advancement.

It is preferred in accordance with this invention that the lower inductor 38 be powered at a relatively high frequency so as to provide minimal penetration depth of the induced current in the cast strip S. The upper inductor 39 on the other hand is preferably powered at a much lower frequency in order to save power consumption as described in Pryor et al.

Since the fluidized bed cooling system 15 in this embodiment is a secondary cooling system a suitable non-magnetic and non-conductive shield I is secured below the gas coolant application manifold 52. The gas coolant manifold 52 surrounds the strip S and is arranged to direct a curtain of inert gas directly against the solidifying casting S in an upwardly manner so as to travel past the molten material in the strip forming casting zone 53 and then past the molten material in the sump 13 and then into the inner chamber 17. A suitable exhaust valve K is provided to maintain control of the pressure in the inner chamber 17 at a desired level. If the gas from the coolant manifold 52 is adequate to provide the desired pressure of inert gas in the inner chamber 17 then it is unnecessary to supply additional gas from the inert gas supply 18 via conduit C as in FIG. 1.

The connection between the inert gas supply 18 and the gas coolant manifold 52 has not been shown, however, it can be accomplished by any well-known conduit type connection and does not form part of the invention herein. The gas coolant manifold 52 also includes a port or ports to provide a gas flow directed downwardly which serves to seal the gap between the non-magnetic insulating shield I and the strip S being cast so as to prevent particles and gas from the fluidized bed 25 from entering into the casting zone 53 or the chamber 17.

The fluidized bed cooling system 15 includes an inert gas plenum 21 arranged below the fluidized bed 25 and separated therefrom by a suitable screen 23. The plenum 21 is constructed in a conventional fashion to provide a substantially uniform flow of inert gas directed in an upward vertical direction. The top surface 24 of the fluidized bed extends when fluidized at least to the height at which the bed is intended to impact the material being cast S. In FIG. 2 the fluidized bed in operation extends somewhat beyond that height so that the shields I determine the height to which the bed 25 contacts the strip S.

The cooling effect of the fluidized bed 25 is a function of both the inert gas and the particle temperatures. Since the casting process is preferably continuous and the bed 25 will tend to heat up additional cooling of the bed 25 can be provided by a heat exchanger 34 comprising a surrounding water cooling jacket about the bed wall 35. There are many well-known alternative heat exchangers for this purpose. For example, it could consist of coils (not shown) running through the bed. A flow of water through the jacket 34 can be established by means of a conventional pump and recirculating circuit arrangement (not shown). A heat exchanger (not shown) in the recirculating circuit can serve to reduce the temperature of the coolant before it flows into the input port 60 and flows about the jacket 34 and then out the output port 61 back to the heat exchanger and pump.

The portion 26 of the casting chamber 11 above the fluidized bed is flared outwardly to provide a disengagement zone to reduce the flow of particles out of the chamber 11. By controlling the flow of inert gas through the fluidized bed plenum 21 it is possible to fluidize the bed of particles to the desired height to provide contact to the material being cast S at the desired secondary position. Some particles will, of course, remain entrained in the inert gas and be exhausted through the port 27 of the casting chamber 11 to be processed and filtered out as described in reference to FIG. 1. Replenishment of the particles in the fluidized bed 25 will be achieved in the manner described in accordance with FIG. 1 via replenishment port 62.

In operation a positive gas pressure would be established in the inner casting chamber 17 to prevent particles from flowing up into that chamber. The gas cooling manifold 52 would be actuated to seal the inner casting chamber 17 against the fluidized bed cooling system 15. The particles which at start up would be arranged on the screen would then be levitated to form the fluidized bed by providing the flow of inert gas through the fluidized bed plenum 21. Water would be circulated through the cooling manifold 34 so that the walls of the fluidized bed system would act to reduce the temperature of the fluidized bed 25 so that it would remain as an effective coolant system even though the bed particles are not circulated through the system.

In the embodiment shown the strip exiting the casting chamber is sealed against the atmosphere by conventional resilient wipers 36.

The initial flushing of the inner casting chamber 17 with inert gas prior to start up can be supplied via conduit C and can be controlled by means of electrically operated valve 63. After the inner chamber 17 is sufficiently flushed out the gas coolant manifold 52 is also actuated to provide a flow of gas both downwardly to seal the opening to the fluidized bed chamber 22 and upwardly to provide a flow of gas about the material to be cast. If the pressure in the inner casting chamber 17 exceeds a desired level, the flow of gas from the inert gas supply through valve 63 can be reduced or eliminated. If necessary, the pressure can be further reduced by exhausting the excess inert gas through exhaust valve K for recirculation back to the inert gas supply 18. The casting process electromagnetic or otherwise may be carried out in a conventional fashion once the cooling system is operational.

It is within the scope of this invention to be able to control the cooling rate in the fluidized bed 25 by varying the temperature of the levitating gas. This feature is considered to be particularly desirable in the case of materials such as silicon which are inherently brittle as solidified and which require stress relief annealing in order to exhibit some slight ductility. Of course, the use of heated fluidized beds 25 obtained by preheating the gas stream via heater 64 is obviously confined to those implementations of the casting process that do not require maximum solidification rates.

The particle materials used within the fluidized bed 25 are not critical as long as they have thermal and dimensional stabilities within the proposed conditions of use. Purified silica is an excellent material for use in the fluidized bed. If lower density materials are required to levitate the bed 25 under conditions of lower gas flow, less dense materials such as alumina or magnesia can be used. Other bed particles can be used as desired.

The use of the fluidized bed coolant system 15 as a secondary cooling system will not provide high casting rates for certain materials being cast. For example, silicon has such a low thermal conductivity in the solid state below a given temperature that the application of secondary cooling will have little effect on the casting rate. However, other materials when solidified will have adequate thermal conductivity so that there might be an effect of secondary cooling on the casting rate. For such systems the use of a fluidized bed cooling as a secondary coolant application system should provide desired high casting rates.

Figure 4:
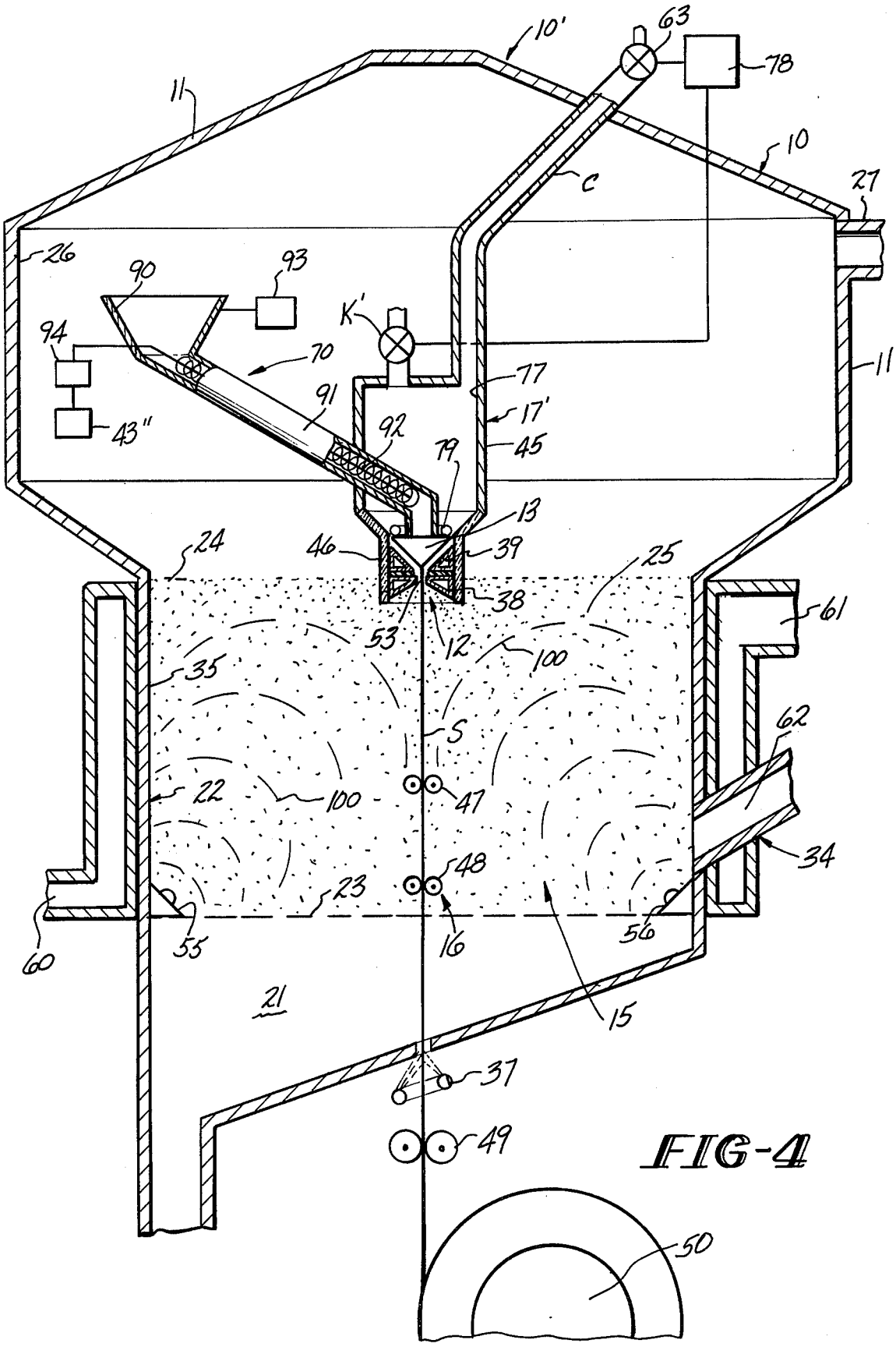
FIG. 4 is a schematic representation of the casting and cooling system in accordance with a different embodiment of the present invention.

For materials requiring even higher casting rates it is proposed in accordance with this invention to utilize the fluidized bed coolant application system 15 as a primary coolant system. Referring now to FIGS. 4 and 5, an apparatus 10' and process in accordance with such an embodiment of the invention will now be illustrated. In this embodiment similar elements of the apparatus 10' have been given corresponding reference numerals as compared to the previous embodiment. Accordingly, only the differences between the apparatus 10' of this embodiment and the apparatus 10 as previously described will be discussed in detail. The biggest difference, of course, is that there is no primary gas coolant application manifold 52. Further, there are no non-magnetic, non-conductive shields I attached to the inductor 38 to seal against the fluidized bed coolant application system 15. Finally, the replenishment system 14 used for replenishing the molten material as it is cast comprises a particle type replenishment system 70 in place of the solid member 40. The arrangements for powering the inductors 38 and 39 in this embodiment are essentially the same as that described in reference to the embodiment of FIGS. 1 to 3. The replenishment system 70 which is illustrated in FIG. 4 employs particulate materials, however, any desired replenishment system as, for example, the same type of solid member feed system 14 as in FIG. 5 or a molten material feed system (not shown) if desired could be used.

The inductors 38 and 39 are secured at one end of the inner casting chamber 17 which is preferably formed of a non-magnetic, non-conductive material such as alumina. The inductors 38 and 39 in this embodiment as in the previous one comprise an upper inductor 39 having a flared out region for supporting a flared out sump 13 of molten material and a lower inductor 38 having a very narrow zone for shaping the material into the desired thin strip shape. The lower inductor 38 is flared outwardly and downwardly so as to provide a very thin edge of the inductor adjacent the strip forming section or zone of the mold. This flared out design also provides access for the fluidized bed 25 all the way up to the casting zone 53 and if desired, even up to the level of contact with the molten material just past the solidification front 75. The upper level 76 of the fluidized bed 25 at the casting zone 53 is controlled by the pressure of the inert gas in the inner casting chamber 17′ which is flow directed in opposition to the direction in which the inert gas and particles are flowing in the fluidized bed coolant system 15. This oppositely directed flow can be provided in any desired manner.

One gas flow can be provided from the source of inert gas 18 as in FIG. 1 through conduit C which communicates with the internal casting chamber 17′. Since the inductors 38 and 39 are effectively sealed to the inner walls 77 of the chamber 17′ the only path for the gas which flows into the chamber 17′ is downwardly between the molten material sump 13 and the upper inductor 39 and then through the casting zone 53 toward the fluidized bed 25. By properly balancing the pressure of the inert gas in the internal casting chamber 17′ with the pressure of the inert gas in the fluidized bed 25 it is possible to control the height 76 of the fluidized bed at the casting zone 53. This height can be controlled either by controlling the pressure of the inert gas in the internal casting chamber 17′ or independently controlling the pressure of the inert gas in the fluidized bed chamber 22 or a combination thereof.

Preferably, it is controlled by controlling the pressure of the gas in the internal casting chamber 17′. Therefore, it is controlled by a control system 78 connected to electrically operated valve 63. By adjusting this valve in a conventional manner it is possible to control the amount of the inert gas pressure in the internal casting chamber 17′. Therefore, if the pressure exerted by the fluidized bed 25 inert gas is essentially fixed it is possible to control the level 76 to which the fluidized bed coolant will rise in the casting zone 53.

Alternatively, if desired, the inert gas supplied through conduit C can be initially used to flush the system before start up. Thereafter, it can be supplemented by means of a gas application manifold 79 which directs the gas between the sump 13 of molten material and the sump supporting inductor 39. The pressure of the gas in the internal casting chamber 17′ can then be controlled either by controlling the pressure of the gas flowing from the manifold 79 or by allowing the manifold to flow at a constant flow and pressure and then controlling the combined gas pressure in the internal chamber 17′ by means of the valve 63. Alternatively, a preset or electrically operated exhaust flow control valve K′ can be used to regulate the pressure in the chamber 17′. If electrically controlled, it would be connected to the control system 78.

Alternatively, the inert gas pressure in chamber 17′ can be fixed and the pressure in bed chamber 22 varied by changing the inert gas flow rate by means of fan 19 whose speed is controlled by control system 80 as in FIG. 1. Finally, a combination of these approaches could be employed as desired.

As a further alternative, since it is possible to employ the apparatus of this invention without an internal chamber 17′ the counter pressure for regulating the height 76 of the bed at the casting zone 53 could be provided solely by the gas flowing from manifold 79 into the annulus between the containment inductor 39 and the sump 13. With this approach the pressure from the manifold 79 would be controlled by the control system 78.

In operation pressurized cold inert gas is fed into the annulus or gap between the containment inductor 39 and the levitated molten material sump 13 at a pressure of $p_1$. The bed 25 is fluidized from below at a pressure $p_2$. $P_1$ and $p_2$ interact in the vicinity of the narrowest annulus of the shaping inductor 38, namely, the casting zone 53. $P_1$ can be slightly higher than $p_2$ and provides a seal against the fluidized bed 25. By adjusting as described above the relative difference between $p_1$ and $p_2$, the surface 76 of the fluidized bed 25 can be moved upwards or downwards at will, as the difference between $p_1$ and $p_2$ is either decreased or increased, respectively. This can provide a means for controlling the liquid solid interface position as an alternative to the arrangement of the Yarwood et al. (3) patent.

In operation the use of the differential gas pressure to control the most upstream position of contact of the fluidized bed would likely include flow of the inert gas for fluidizing the bed into and through the annulus between the sump and the inductor. The counter pressure exerted by the gas in the inner chamber most likely serves to reduce the flow rate of the fluidizing gas and thereby controls the position at which the fluidization of the particles ends which position corresponds to the most upstream position of the bed.

The particulate feed system 70 comprises a hopper 90 for replenishment material in particulate form. The hopper is located in the outer casting chamber 11 and is connected via a conduit 91 which extends into the inner casting chamber 17′. The conduit 91 or chute includes internally thereof a helical screw or spring type member 92 which feeds the particles from the supply hopper 90 to the molten material sump 13. By rotating this helical member 92 it is possible to control the addition of the particles to the molten material sump 13 in a manner so that the number of particles added to the sump corresponds to the amount of rotation of the helical member 92. In order to insure proper feeding of the particles from the hopper 90 a vibrator 93 is utilized to vibrate the hopper. A motor 94 is connected to the helical screw member 92 and is controlled by the control system 43″ in a manner similar to that described in the previous embodiment. Namely, as described above, an electrical parameter corresponding about to the hydrostatic pressure of the molten material sump 13 is sensed and in response thereto the helical screw 92 is rotated a desired amount or at a desired rate in order to add solid particles to the molten material sump 13 at a rate which will maintain the hydrostatic pressure substantially constant to provide a substantially constant height for the sump 13.

As in the previous embodiment, the electromagnetic casting system 12 and the inner chamber 17′ are designed in a way so as to present a minimum obstruction to the gas flow for forming the fluidized bed 25. This has been accomplished by making the width of the fluidized bed 25 relatively great as compared to the width of the casting station 12. It is possible, however, that even with these measures the casting mold 12 may sufficiently alter the flow pattern of the fluidized bed due to its effect as an obstruction that it will not be possible to get sufficient activity of the fluidized bed 25 all the way up to the casting zone 53. In order to overcome this difficulty, it is proposed to augment the cooling effectiveness of the fluidized bed 25 in the region of the casting zone 53. This is accomplished by providing flow enhancing means 54 which can enhance the flow of the fluidized bed 25 into the inverted "V"-shaped cavity defined by the inductor 38 so that the bed 25 can reach and contact the strip S at the casting zone 53.

Referring to FIG. 4, this is accomplished through the use of sound generators 55 and 56 which generate sound waves 100 moving in the direction so as to impact the strip S near the casting zone 53. In the embodiment of FIG. 4, the transducers 55 and 56 which generate the sound waves 100 are located at the bottom outer corner of the fluidized bed chamber 35. In this manner they will pose a minimum obstruction to the flow of gas through the fluidized bed 25.

Alternatively, in place of sound generators 55 and 56 directing sound waves in the general direction of the casting zone 53 a more focused beam of sound waves 100' can be provided as in FIG. 6. In this embodiment, the sound wave generators 55' and 56', which preferably generate ultrasound waves, are located just below the lower inductor 38 and they provide a focused beam of ultrasound impacting the material being cast S at the casting zone 53. As positioned, the transducers which make up the generators 55' and 56' would be subject only to heat radiation on the front surface and could be adequately cooled by any desired means (not shown) as, for example, a water cooling coil attached to the back of the transducers. In this embodiment a stream of suspended particles can be directed against the strip S and molten material surface if desired due to the focused effect of the ultrasonic beam.

The ultrasonic generators 55' and 56' can comprise any desired well-known ultrasonic generating device including nickel-stack magnetostriction transducers or a piezoelectric transducer as, for example, the Mullard PXE ceramic element. The sound waves may be of any desired frequency and may be generated in any desired manner. For lower frequencies an acoustical speaker like device could be employed, e.g., a moving coil and diaphram arrangement. Sound waves having a frequency from about 10 hertz to about 15 megahertz should be employable for providing the desired flow enhancement. Preferably, the frequency which is selected is low enough to accelerate the particles to provide the desired directional enhancement.

Sound waves 100 or 100' represent a preferred approach for enhancing the cooling effect in the "V"-shaped cavity formed by the lower inductor 38. However, other approaches as shown in FIGS. 7 and 8 could also be employed. In FIG. 7, small fans 105 are employed to provide a preferred flow direction for the fluidized bed 25 so that the bed will be efficiently operative in the casting zone region 53. In accordance with the embodiment of FIG. 8, in place of fans 105 gas jets 106 are generally directed towards the casting zone region 53 to provide the enhancement of the fluidized bed 25 action in that region. The gas flow created by the fans 105 or jets 106 must be limited in a manner so as not to destroy the fluidized character of the bed. Therefore, the flow rates should be selected as desired in a manner to provide flow enhancement without destroying the fluidized nature of the bed.

While this invention has been described with particular reference to the use of electromagnetic casting it is possible to employ the fluidized bed coolant application system 15 of this invention with other types of casting apparatuses and processes, particularly those of a continuous or semi-continuous nature such as direct chill casting. While the invention has been described to be particularly applicable for the casting of thin strip shapes it could be employed if desired with other shapes and with relatively thicker materials. Thin strip shapes in accordance with the present invention preferably refer to strip thicknesses up to about 0.150" and most preferably up to about 0.1".

The present invention when employing electromagnetic casting is applicable to the full range of materials to which such a system can be applied and, in particular, it is applicable to materials which are electrically conductive in the molten state. Preferably, it is applied to metals, metalloids, semi-conductors, alloys, etc. It has particular application to materials such as silicon and germanium as well as to reactive metals and alloys.

The term casting zone 53 as employed in this application refers generally to the containment and shaping region defined by the inductor 38. The coolant application zone can extend over the whole casting zone 53 or it can be limited to only the solidified surface of the casting S or in any manner desired.

The particle sizes of the fluidized bed particles and the flow rates of the inert gas for fluidizing the particles may be set as desired in accordance with well-known principals as evidenced by the prior art noted in the background of this application. Accordingly, any desired conventional particle size or gas flow rate could be used in accordance with the present invention.

While the invention has been described utilizing a counter gas pressure created by the manifold 79 or inner chamber 17 or 17' it is possible to operate the apparatus of the present invention without any counter gas pressure for sealing the fluidized bed at the casting zone. In such an approach the height or position at which the top surface of the fluidized bed in the casting zone would be determined solely by the pressure of the fluidizing gas and there would be flow of the fluidizing gas through the annulus between the sump and the sump supporting inductor.

The U.S. patents, applications and publications set forth in this application are intended to be incorporated by reference herein.

It is apparent that there has been provided in accordance with this invention an apparatus and process for cooling and solidifying continuous or semi-continuously cast material which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A process for casting material comprising: pouring said material into a casting means defining a casting zone, and applying a fluidized bed of particles to cool said material; the improvement comprising:

enhancing a flow of said fluidized bed particles toward said casting zone, said flow enhancing step comprising generating sound waves moving toward said casting zone which act on said particles to enhance said flow.

2. A process according to claim 1 wherein said casting material is a metal or a metal alloy.

3. A process as in claim 1 wherein said generator generates sound waves having a frequency selected to accelerate said particles toward said casting zone.

4. A process as in claim 3 wherein said sound waves comprise ultrasonic waves.

5. A process as in claim 3 wherein said generating step comprises generating a focused pattern of sound waves directed at said casting zone.

6. A process as in claim 1 wherein said casting step is carried out continuously or semicontinuously.

7. A process as in claim 1 wherein said step of applying a fluidized bed of particles to cool said material comprises applying inert particles and flowing an inert gas for fluidizing said bed of particles.

8. A process as in claim 7 wherein said casting step comprises electromagnetically containing and forming said material into a desired casting shape.

9. A process as in claim 8 wherein said electromagnetic containing and forming step defines a casting zone and wherein said fluidized bed first contacts said casting at said casting zone.

10. A process as in claim 9 wherein said fluidized bed contacts said material in both molten form and solidified form at said casting zone.

11. A process as in claim 1 wherein said gas comprises an inert gas selected from the group consisting of helium and argon and mixtures thereof.

12. A process as in claim 11 wherein said particles comprise particles of a material selected from the group consisting of silica, magnesia, alumina and mixtures thereof.

13. A process as in claim 1 wherein said casting step comprises casting said material in a thin strip shape.

14. An apparatus for casting material comprising:

means for casting said material, said casting means defining a casting zone, said casting means including means for applying a fluidized bed of particles to cool said material; the improvement comprising:

means associated with said fluidized bed for enhancing a flow of said fluidized bed particles toward said casting zone, said flow enhancing means comprising means for generating sound waves moving toward said casting zone.

15. An apparatus as in claim 14 wherein said generator generates sound waves having a frequency selected to accelerate said particles toward said casting zone.

16. An apparatus as in claim 15 wherein said sound waves comprise ultrasonic waves.

17. An apparatus as in claim 15 wherein said sound wave generators are located a substantial distance away from said casting zone so as not to interfere with a gas flow for fluidizing said particles of said bed.

18. An apparatus as in claim 14 wherein said generators are located close to said casting zone and wherein said generators provide a focused pattern of sound waves directed at said casting zone.

19. An apparatus as in claim 14 wherein said casting means is adapted for continuous or semicontinuous casting of said material.

20. An apparatus as in claim 14 wherein said means for applying a fluidized bed of particles to cool said material comprises inert particles and means for flowing an inert gas for fluidizing said bed of particles.

21. An apparatus as in claim 19 wherein said means for casting said material comprises electromagnetic means for containing and forming said material into a desired casting shape.

22. An apparatus as in claim 21 wherein said electromagnetic means defines said casting zone and wherein said fluidized bed first contacts said casting at said casting zone.

23. An apparatus as in claim 11 wherein said fluidized bed in operation is adapted to contact said material in both molten form and solidified form at said casting zone.

24. An apparatus as in claim 30 wherein said gas comprises an inert gas selected from the group consisting of helium and argon and mixtures thereof.

25. An apparatus as in claim 24 wherein said particles comprise particles of a material selected from the group consisting of silica, magnesia, alumina and mixtures thereof.

26. An apparatus as in claim 14 wherein said means for casting said material comprises means for casting said material into a thin strip shape.

* * * * *